United States Patent [19]

Ahlborn et al.

[11] 4,278,030

[45] Jul. 14, 1981

[54] TRUCK FOR HIGH SPEED RAIL CARS

[75] Inventors: Günther Ahlborn; Eberhard Fiedler; Henry Hübsch; Rolf Kramer, all of Siegen, Fed. Rep. of Germany

[73] Assignee: Waggon Union GmbH, Fed. Rep. of Germany

[21] Appl. No.: 971,218

[22] Filed: Jan. 8, 1979

Related U.S. Application Data

[63] Continuation-in-part of Ser. No. 705,424, Jul. 15, 1976, abandoned.

[30] Foreign Application Priority Data

Mar. 20, 1976 [DE] Fed. Rep. of Germany ..... 2611924

[51] Int. Cl.[3] ..... B61F 5/00

[52] U.S. Cl. ..... 105/208.1; 105/190 R; 105/197 B

[58] Field of Search ..... 105/182, 194, 197 B, 105/197 A, 197 R, 198, 199 A, 197.1, 208.1, 224 R, 224 A, 224.1, 190 R, 208, 218 A

[56] References Cited

U.S. PATENT DOCUMENTS

| | | | |
|---|---|---|---|
| 3,400,668 | 9/1968 | Lich | 105/197 R X |
| 3,782,294 | 1/1974 | Sundby | 105/190 R X |
| 3,845,724 | 11/1974 | Boocock | 105/190 R X |
| 3,889,936 | 6/1975 | Shimizu | 105/197 B X |
| 3,941,061 | 3/1976 | Schindehutte | 105/182 R X |

FOREIGN PATENT DOCUMENTS

| | | | |
|---|---|---|---|
| 118105 | 2/1947 | Sweden | 105/194 |

*Primary Examiner*—David M. Mitchell
*Assistant Examiner*—D. W. Underwood
*Attorney, Agent, or Firm*—McGlew and Tuttle

[57] ABSTRACT

A truck for high speed rail cars, comprises an H-shape truck frame which included bearings for supporting each end of the axles of each wheel set from longitudinally extending leaf springs which are supported in brackets depending from the frame. In addition, air springs are supported on spring troughs which are supported by connecting rods that are pivotally connected between the frame and the troughs. The air springs on the troughs support a cradle which includes spaced upper and lower beam portions or chord members having one or more spaces enclosed therebetween which form auxiliary air spaces providing an additional air chamber for the air springs which are between the troughs and the upper chord member of the cradle.

2 Claims, 7 Drawing Figures

TRUCK FOR HIGH SPEED RAIL CARS

CROSS REFERENCE TO RELATED APPLICATIONS

This is a continuation-in-part of Ser. No. 705,424 filed July 15, 1976 and now abandoned.

FIELD AND BACKGROUND OF THE INVENTION

This invention relates in general to the construction of railroad cars and, in particular, to a new and useful truck for high speed rail cars.

DESCRIPTION OF THE PRIOR ART

Many types of rail trucks are known, including ones, for example, which include a bearing socket which is arranged on a cradle which bears with its length sides over coil or rubber springs on cradle troughs. The cradle troughs are suspended by means of pendulums on the longitudinal beams of the H-shape truck frame. The axles of the truck frame are mounted over primary springs on the longitudinal beams of the truck frame and are articulated by means of leaf spring guide rods supported from the frame. The connecting rods connecting the spring troughs and the cradle ensure a controlled relative movement between these two elements.

It is also known to arrange air springs on the cradle troughs to spring the cradle. These air springs offer, in addition to the other advantages, the possibility of regulating the level of the car body suspension. With a controlled air suspension, the means contraction is maintained by adapting the spring pressure to the load of the bellows. At the same time, the spring constant is changed so that the dynamic spring behavior with empty and partly or completely loaded vehicles remains optimal. Such an air suspension requires a relatively large installation space. Attempts have been made to obtain the required bellows volume by arranging an auxiliary air chamber in the cradle which is connected to the air spring proper through connecting elements. In these connecting elements, there are arranged throttles or valves which regulate the velocity of air flow with a dynamic spring. Attempts have also been made to use the cradle box type directly as an auxiliary air chamber. Since the cradle is greatly offset for constructional reasons, many welded seams are required. These welded seams cannot be produced economically, so that this type of auxiliary air chamber is uneconomical and difficult to effect. Another disadvantage of the known arrangements is that the cradle has a relatively large cross-section in the range of the air spring and this has an adverse effect on the installation space for the air spring.

Among the closest prior art in this area is U.S. Pat. No. 3,400,668 to Lich. In this patent a car truck is equipped with pneumatic springs which are supported on a bolster or trough which is supported from the frame of the truck. The truck in the reference is provided with auxiliary air chambers which communicate with the pneumatic springs. A particular new and useful construction for an auxiliary air chamber similar to that used in the Lich patent is a primary concern of the present invention.

In the Lich patent, the air chambers are formed by upper and lower chords of the bolster construction and side walls or webs connecting the upper and lower portions to each other. It is a disadvantage of the construction in this patent that the air chambers walls are flat. The auxiliary air chamber which is contemplated for use in accordance with the invention is exposed to pressures on the order of 20 bar and such pressures would require an exceedingly thick wall construction where flat walls as disclosed in the Lich patent are used. The use of such thick steel walls produces an undesirable weight increase in the truck construction. Another disadvantage of the prior art structure is the number of welded seams required to enclose the auxiliary air chamber and the difficulty of producing such welds in view of the positioning and otientation of these welded seams. Another factor to be considered is the fact that the auxiliary air chamber is disposed within a component part of the truck which is exposed to high torsion forces thereby placing additional demands on the welded seams and air chamber construction as a whole.

Other patents which are relevant to the present invention are U.S. Pat. No. 3,845,724 to Boocock et al for showing an H-frame railroad truck and U.S. Pat. No. 3,782,294 to Sundby for showing a railroad truck construction using coil springs and air springs.

SUMMARY OF THE INVENTION

The present invention provides a construction of a truck for high speed rail cars, wherein the cradle is designed so that an optimum space is available for the installation of the air spring and also, it provides a space for the required auxiliary air chambers which can be integrated into the cradle in an economical manner. In accordance with the invention, the auxiliary air chambers comprise conduits or pipes whose longitudinal ends are covered by the upper chord and the lower chord of the cradle. The lower chord of the cradle has at its longitudinal end an aperture for receiving the air spring. The air spring bears with its upper bottom flat top on the underside of the upper chord and it is detachably connected to the upper chord. Vertical straps are arranged on the upper chord of the cradle in the range of the air spring on both sides of the longitudinal beams of the truck frame and parallel to the truck frame at a distance from each other which corresponds at least to the maximum transverse deflection of the cradle.

The invention provides auxiliary air chambers in the cradle which comprise simple elements connected under the upper cradle chord member which can be economically arranged. The air springs themselves are so arranged in recesses of the lower chord of the cradle that only the upper chord of the cradle limits the installation space for the air spring which is between a spring trough and the bottom edge of the longitudinal beams of the truck. The vertical straps arranged on the upper chord on both sides of the longitudinal beam of the truck frame ensure the necessary rigidity of the cradle in the range of movement of the air spring.

Due to the design of the cradle, according to the invention, the auxiliary air chambers are arranged in an economical manner. The space available for the installation of the air spring between the trough and the trough and the upper chord of the longitudinal beam of the truck can also be optimally utilized.

Accordingly, it is an object of the invention to provide an improved truck for high speed rail cars which comprises an H-shape truck frame which has wheel sets supported on axles which are suspended by springs held in brackets on the frame and which also includes spring support troughs which are pivotally connected to the frame and which support a cradle which includes spaced upper and lower chord members to which an air spring is secured and which define between them and transverse walls, an air space or air conduit which is connectable to the air spring and provides an additional air chamber therefor.

A further object of the invention is to provide a truck for high speed rail cars which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 2:
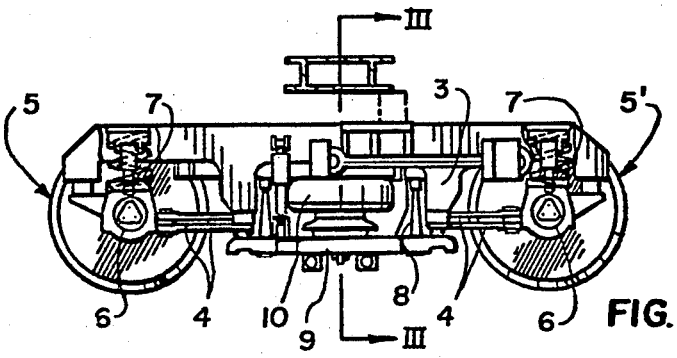
FIG. 2 is a side elevational view, partly in section, of the truck shown in FIG. 1.

Referring to the drawings in particular, the invention embodied therein comprises a truck for a high speed rail car which includes an H-shape truck frame having transversely spaced longitudinal members 1, which are of rectangular box section and are connected at their central area to transverse members or cross-beams 2, 2. Brackets 3 are secured to the undersides of the longitudinal beams and support one end of spring leaf guide rods or spring leaf links 4 which extend longitudinally. The outer ends of the leaf links 4 support bearing means or axle box cases 6 for the respective ends of the axles of the wheel and axle sets, generally designated 5 and 5'. The wheel axles bear on the truck frame over axle box cases 6 and primary springs 7 which are advantageously designed as coil springs (see FIG. 2).

Figure 1:
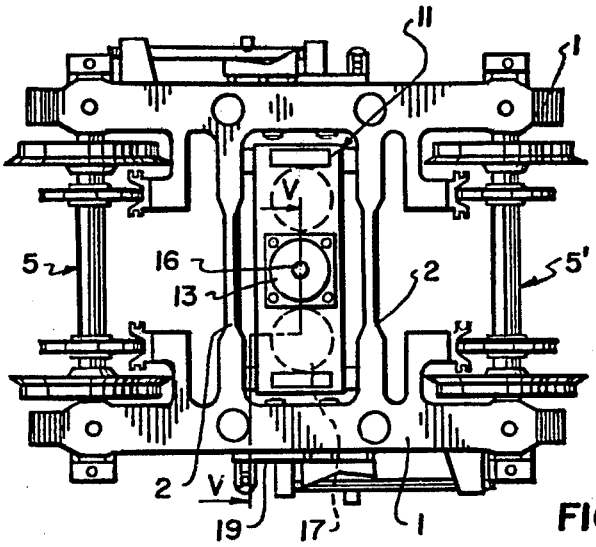
FIG. 1 is a top view of a truck for high speed rail cars constructed in accordance with the invention.
Figure 3:
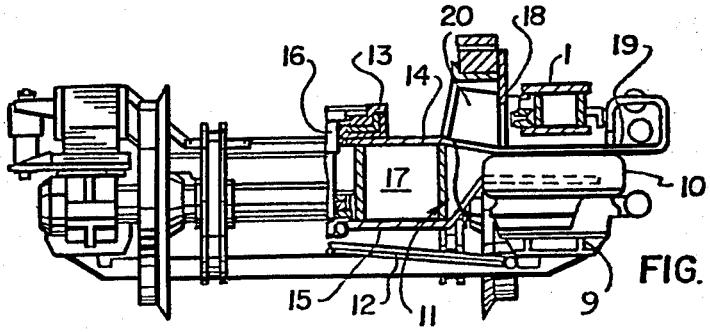
FIG. 3 is a partial or half front elevational view and half sectional view with the section being taken along the line III—III of FIG. 2.
Figure 4:
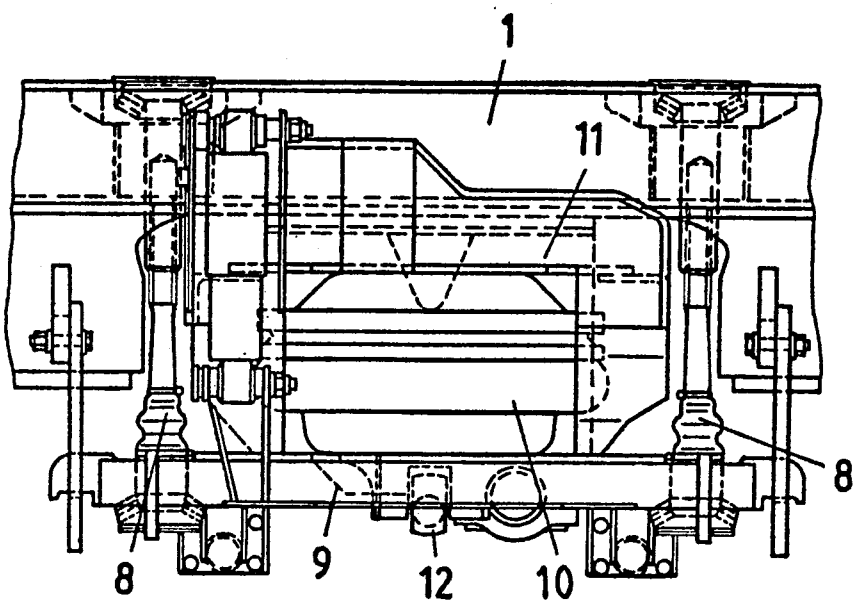
FIG. 4 is an enlarged detailed view with portions cut away of the central area containing the bolster and air spring of the invention shown in FIG. 2.
Figure 5:
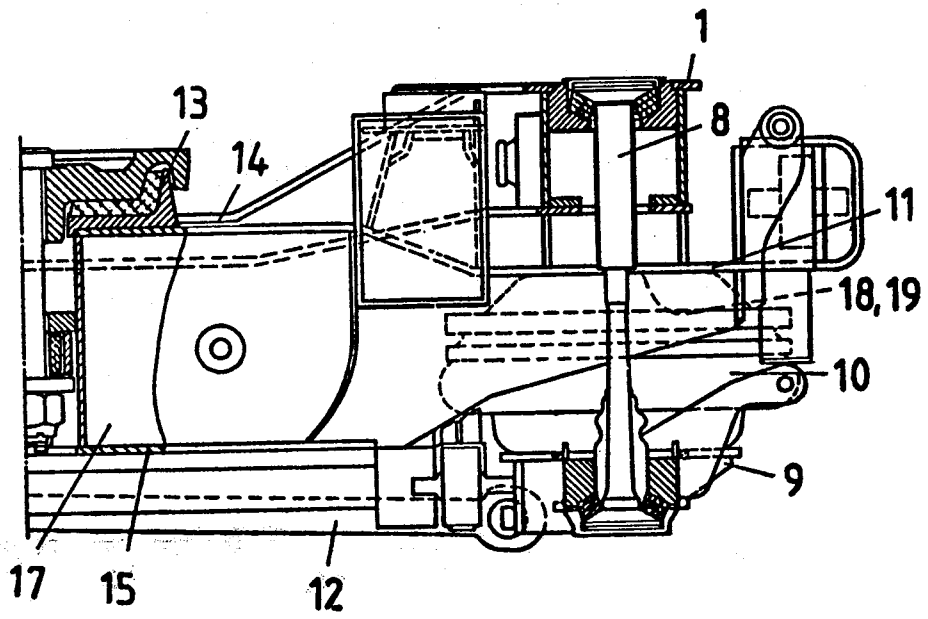
FIG. 5 is an enlarged detailed view with portions cut away of the invention as shown in FIG. 3 showing portions of the auxiliary chamber and the air spring with its mountings on the bolster or trough as taken along the line V—V in FIG. 1.
Figure 6:
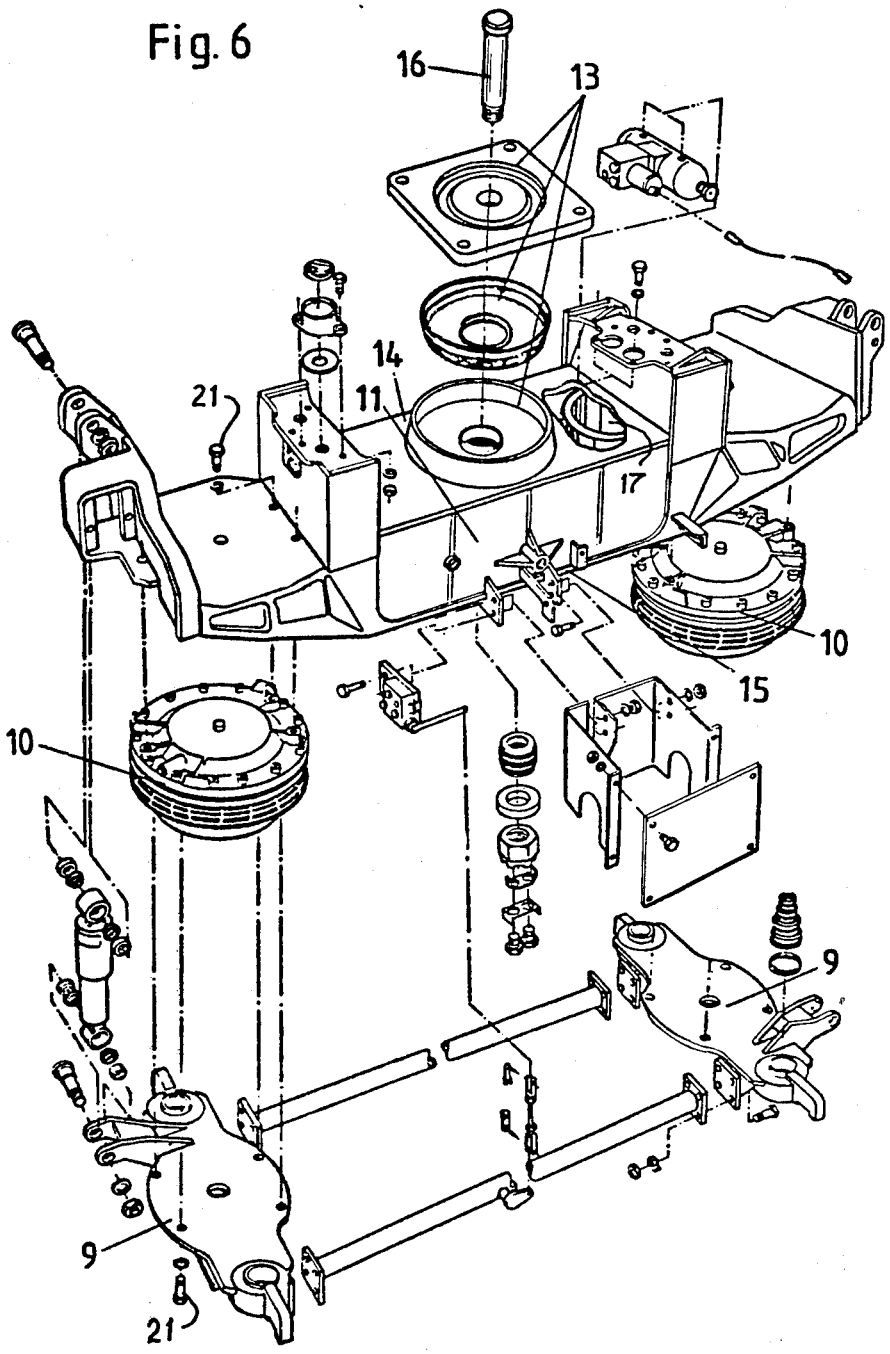
FIG. 6 is an exploded perspective view of the cradle system used in accordance with the invention and parts associated therewith.
Figure 7:
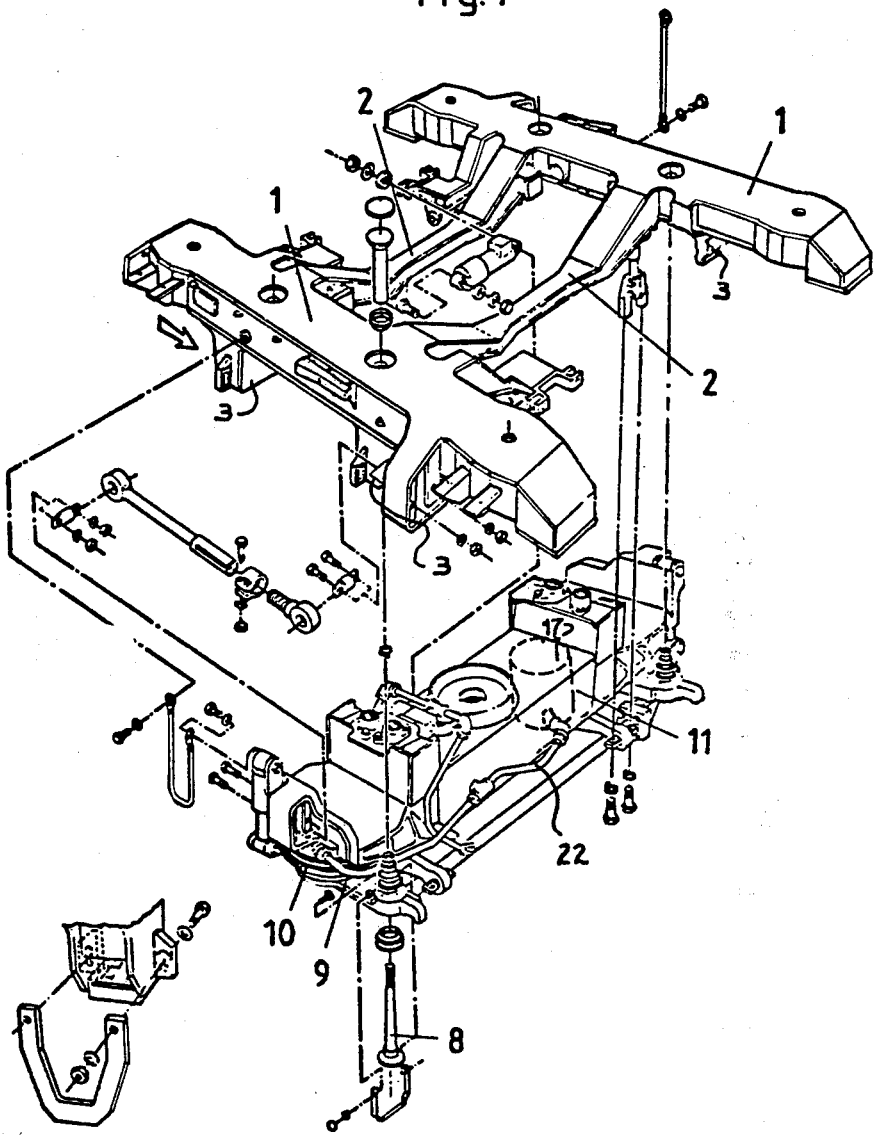
FIG. 7 is a perspective exploded view of the cradle and frame combination in accordance with the invention.

To the right and left and symmetrical of the transverse center of the truck are arranged troughs 9 which are pivotally supported on swing hangers or rod members 8. An air spring 10 is mounted on each of the spring troughs 9 and advantageously air spring 10 is also provided with an emergency support (not shown). Each trough 9 supports and air spring 10 which is detachably mounted, by for example bolts 21 as seen in FIG. 6, on its flat top face or upper portion to an upper beam member or chord 14 of a cradle 11. As shown in FIGS. 1, 3 and 7, cradle 11 extends across the truck frame substantially between the longitudinal members 1, 1 and the transverse members or cross beams 2, 2. The trough 9 supports one air spring 10 in the area of each longitudinal member 1 with each air spring being positioned between two hangers 8. Each hanger 8 is pivotally mounted at its upper end with the longitudinal frame 1 as seen in FIG. 5. The central portion of cradle 11 carries central bearing 13 on the top thereof which supports pin 16 which is connected to a railroad car not shown. The weight of the railroad car is thus partly supported on each air spring 10 through the cradle 11, trough 9, swing hangers 8 and longitudinal members 1. The cradle 11 and the spring trough 9 are connected with each other by means of hinge connecting rods 12 (only one being shown in FIG. 3 and their overall connection being shown in exploded view in FIG. 6). Rods 12 extend transversely to the trough so as to prevent the cradle 11 and the spring trough 9 from moving relative to each other in an uncontrolled manner.

The cradle 11 comprises both an upper chord 14 and a lower chord 15 which are spaced apart so as to define a space therebetween. Upper and lower chords 14 and 15 respectively are connected to each other in the area between bearing socket 13 and air springs 10, by a tubular construction defining an auxiliary air chamber 17 as seen in FIGS. 1, 3 and 6. Upper chord 14 and lower chord 15 extend in the range of the bearing socket 13 and up to the springs 10 substantially parallel to each other. On both sides of the socket bearing pin 16, which serves to connect the parts to bearing socket 13, there are arranged these auxiliary air chambers 17, which are designed as conduits or pipes between the upper chord 14 and the lower chord 15 of the cradle 11. Auxiliary air chambers 17 serve both as straps on the static system of cradle 11 and also as auxiliary air chambers for the air springs 10. As shown in FIG. 7, the air cavity of air springs 10 are connected to air chamber 17 through a conduit 22. From the auxiliary air chambers 17 to the length sides of the cradle, the upper chord 14 and lower chord 15 of cradle 11 are offset toward each other and then extend parallel for a slight distance. Lower chord 15 of cradle 11 is provided in this area with an aperture for receiving air spring 10 (see FIG. 3). Air spring 10 is disposed in this recess with its upper part flat on the underside of upper chord 14 and it is detachably connected to upper chord 14 as aforementioned. Frame straps 18 and 19 are arranged on the top side of the upper chord 14 at the right and left hand side of the longitudinal beam 1 and at a spacing from longitudinal beam 1 and parallel to it. Strap 18 is designed also as a part of the cradle guide rod bearing 20 of the truck. Straps 18 and 19 form the additional reinforcement for the cradle 11 made necessary by the aperture in the lower chord 15 of cradle 11. The admission of air spring 10 and its connection with the auxiliary air chamber 17 are effected through conduits 22, as stated.

As seen in FIG. 3 thus chords 14 and 15 are parallel to each other and spaced from each other by auxiliary air chambers 17 in the mid portion of cradle 11 then converged toward each other as they extend outwardly toward the air spring 10. Upper chord 14 converged downwardly slightly as shown in FIG. 3 and then runs horizontally to the right as shown thus forming the top support for air spring 10. Lower chord 15 extends horizontally in the area of chamber 17 then toward the right obliquely upwardly toward upper chord 14 then again horizontally outwardly and around air spring 10. In this area chord 15 divides into a two pronged fork like structure having one prong disposed on either side of the air spring 10.

While a specific embodiment of the invention has been shown and described in detail to illustrate the application of the principles of the invention, it will be understood that the invention may be embodied otherwise without departing from such principles.

What is claimed is:

1. A truck for high speed rail cars, comprising an H-shaped truck frame having a central transverse beam portion and a longitudinal beam connected centrally to each side of said central beam portion, first and second wheel axle sets each including an axle and bearing means adjacent each end of said axles for rotatably supporting said axle, primary spring means connected between said truck frame and bearing means for supporting said truck frame on said bearing means, a bracket secured to and depending from said truck frame adjacent each of said bearing means, longitudinally extending leaf spring means secured to each bracket and to said bearing means for additionally supporting said truck frame on said bearing means, spring support troughs, swing hanger means connected between said truck frame and said spring support troughs to support said spring support troughs from said truck frame, a transversal cradle extending between and over said spring support troughs carrying a rail car, connecting rod means pivotally connected to said cradle and to said spring support troughs for limiting the swinging movement of said spring support troughs, said cradle including vertically spaced upper and lower chord members and at least one tubular member secured between said upper and lower chord member enclosing an auxiliary air chamber, and one air spring supported between each of said spring support troughs and said cradle and being connectable to said auxiliary air chamber for providing an additional air chamber for said air springs.

2. A truck for high speed rail cars, according to claim 1, wherein said lower chord has an aperture for accommodating each of said air springs, said air springs having a top flat portion which bear against the upper chord member and being detachably secured to said upper chord member.

* * * * *